US011697964B2

(12) United States Patent
Lei et al.

(10) Patent No.: US 11,697,964 B2
(45) **Date of Patent: *Jul. 11, 2023**

(54) ROLLER SHADE ACTUATION DEVICE

(71) Applicant: Leafy Windoware Co., Ltd., Dongguan (CN)

(72) Inventors: Zhenbang Lei, Dongguan (CN); Xingbang Lei, Dongguan (CN)

(73) Assignee: Leafy Windoware Co., Ltd., Dongguan (CN)

( * ) Notice: Subject to any disclaimer, the term of this patent is extended or adjusted under 35 U.S.C. 154(b) by 60 days.

This patent is subject to a terminal disclaimer.

(21) Appl. No.: 17/295,881

(22) PCT Filed: Jun. 25, 2019

(86) PCT No.: PCT/CN2019/092860
§ 371 (c)(1),
(2) Date: May 21, 2021

(87) PCT Pub. No.: WO2020/258054
PCT Pub. Date: Dec. 30, 2020

(65) Prior Publication Data

US 2022/0127906 A1 Apr. 28, 2022

(51) Int. Cl.
*E06B 9/60* (2006.01)
*E06B 9/42* (2006.01)

(52) U.S. Cl.
CPC . *E06B 9/60* (2013.01); *E06B 9/42* (2013.01)

(58) Field of Classification Search
CPC ..... E06B 9/60; E06B 9/42; E06B 9/56; E06B 9/68; E06B 9/40; E06B 9/322
See application file for complete search history.

(56) References Cited

U.S. PATENT DOCUMENTS

| | | | | |
|---|---|---|---|---|
| 10,113,359 | B1 * | 10/2018 | Chen | E06B 9/60 |
| 10,480,244 | B2 * | 11/2019 | Chen | E06B 9/42 |
| 11,028,641 | B2 * | 6/2021 | Lei | E06B 9/60 |
| 11,326,397 | B2 * | 5/2022 | Lei | E06B 9/42 |
| 2010/0319860 | A1 * | 12/2010 | DeWard | F03G 1/00 160/315 |

(Continued)

FOREIGN PATENT DOCUMENTS

CN 207590466 U * 7/2018 ..... A47H 11/06

*Primary Examiner* — Beth A Stephan

(57) ABSTRACT

A roller shade actuation device includes two actuators arranged in a winding drum, a shaft inserted into the winding drum, and a transmission mechanism. Each actuator includes a housing fixed to the winding drum, a rotary power member arranged in the housing, a driving gear fixed to an output shaft of the rotary power member and coaxial with the output shaft, and a first transmission gear rotatably mounted to the housing and meshed with the driving gear. The actuators are connected linearly in sequence. The driving gear of one actuator adjacent to the transmission mechanism is transmission-matched with and connected to the transmission mechanism, and the driving gears of the remaining actuators are meshed with the first transmission gears of neighboring actuators adjacent to the transmission mechanism. The actuators are connected in series to form an actuator combination through the driving gears and the first transmission gears.

6 Claims, 2 Drawing Sheets

(56) References Cited

U.S. PATENT DOCUMENTS

| | | | | |
|---|---|---|---|---|
| 2013/0312920 | A1* | 11/2013 | Mullet | E06B 9/72<br>160/310 |
| 2018/0179812 | A1* | 6/2018 | Dubina | E06B 9/308 |
| 2018/0230744 | A1* | 8/2018 | Huang | E06B 9/38 |
| 2020/0024896 | A1* | 1/2020 | Lei | E06B 9/322 |
| 2020/0157880 | A1* | 5/2020 | Lei | B65H 75/486 |

* cited by examiner

ROLLER SHADE ACTUATION DEVICE

FIELD OF THE PRESENT INVENTION

The present invention relates to the window shade technical field and, more particularly to a roller shade actuation device.

BACKGROUND OF THE PRESENT INVENTION

Opposite ends of a winding drum of a current spring roller shade are mounted to corresponding brackets, and an actuator, a helical spring, a damper, and a limiter are arranged in the winding drum. When the shade body needs to be put down, the shade body only needs to be pulled down, and the shade body will drive the winding drum to rotate and then to rotate relative to the helical spring. The helical spring is twisted and deformed to accumulate elastic force. At the same time, by means of the damper, the shade body can be held at any height position within the effective range of the shade body. When the shade body needs to be rolled up, the shade body only needs to be pushed up, and the force of the helical spring overcomes the damping action of the damper to drive the winding drum to rotate in an opposite direction, thereby rewinding the shade body on the winding drum. However, the current spring roller shade generally only has one actuator, and the output power is limited. Even if at least two actuators are provided, the output shafts of the at least two actuators need to be coaxial, connected in order, and fixed relative to each other, to form an overall external power output. Because the actuators need to be arranged coaxially, the structure is relatively immobilized and the assembly accuracy is high, which is also not conducive to the optimal design of the overall structure.

Technical Problem

Therefore, the technical problem to be solved by the embodiments of the present invention is to provide a roller shade actuation device, which is easy to be assembled and can effectively realize the combined adjustment of driving forces.

Solution of the Problems

To solve the above-mentioned technical problems, an embodiment of the present invention provides a roller shade actuation device for actuating a winding drum with opposite ends rotatably mounted to corresponding frames and an outer side mounted with an end of a shade body. The roller shade actuation device includes at least two actuators arranged in the winding drum, a shaft mounted to one of the frames outside an end of the winding drum and inserted into the winding drum, and a transmission mechanism for realizing power transmission between the at least two actuators and the shaft. Each of the at least two actuators includes a housing fixed relative to the winding drum, a rotary power member arranged in the housing, a driving gear fixed to an output shaft of the rotary power member and coaxial with the output shaft, and a first transmission gear rotatably mounted to the housing and meshed with the driving gear. The at least two actuators are connected linearly in sequence. The driving gear of one of the at least two actuators adjacent to the transmission mechanism is transmission-matched with and connected to the transmission mechanism, and the driving gears of remaining actuators of the at least two actuators are meshed with the first transmission gears of neighboring actuators adjacent to the transmission mechanism.

Furthermore, the transmission mechanism includes a second transmission gear meshed with the driving gear, a synchronous gear coaxial with and fixed relative to the second transmission gear, and a fixed gear fixed to the shaft and meshed with the synchronous gear.

Furthermore, an axial direction of the output shaft of the rotary power member is perpendicular to an axial direction of the shaft, an axial direction of the driving gear is parallel to an axial direction of the first transmission gear, the synchronous gear and the fixed gear are bevel gears whose axial directions are perpendicular to each other.

Furthermore, the second transmission gear, the synchronous gear, and the fixed gear are all disposed in a gear box; a sidewall of the gear box adjacent to the at least two actuators defines a slot through which gear teeth of the second transmission gear extend out, a gear shaft of the fixed gear extends through a sidewall of the gear box adjacent to the shaft to be connected to the shaft and be fixed relative to the shaft.

Furthermore, the sidewall of the gear box adjacent to the at least two actuators forms a first hook, opposite ends of the housing of each of the at least two actuators respectively form a second hook and a hooking portion, one of the at least two actuators adjacent to the gear box is connected to the gear box through the hooking portion of the one of the at least two actuators being hooked to the first hook of the gear box; the remaining actuators of the at least two actuators are connected linearly and integrally in sequence through the hooking portions being hooked to the second hooks of neighboring actuators of the at least two actuators adjacent to the gear box.

Furthermore, the housing includes a bottom shell and a cover shell which are fastened to each other; a side surface of the cover shell away from the bottom shell is a stepped surface, the stepped surface has a high-order surface, a lower-order surface parallel to the high-order surface and closer to the bottom shell, and a connection surface located between the high-order surface and the low-order surface and perpendicular to the high-order surface; the connection surface defines a first through slot communicating with an inner chamber of the housing, the driving gear is arranged inside the housing and near an inner side of the high-order surface, and a gear surface of the driving gear extends out through the first through slot; the first transmission gear is rotatably mounted to the low-order surface.

Furthermore, the housing further includes a cover plate covering the low-order surface of the cover shell and the first transmission gear, a second through slot is defined between sides of the cover plate and the low-order surface, through which a gear surface of the first transmission gear extends out.

Furthermore, opposite ends of the bottom shell are respectively provided with the second hook and the hooking portion, opposite ends of the high-order surface are provided with the hooking portions, and opposite ends of the cover plate are respectively provided with the second hooks, the second hook of the cover plate adjacent to the high-order surface is engaged with the hooking portion of the high-order surface adjacent to the lower-order surface.

Furthermore, the rotary power member further includes a planar scroll spring, and a spring winding frame for winding the planar scroll spring; axial directions of the planar scroll spring and the output shaft are parallel, an outer end of a reed of the planar scroll spring is fixed to a side surface of the output shaft.

Furthermore, each of the rotary power members includes at least two planar scroll springs coaxially wound on the same spring winding frame; the spring winding frame and the output shaft are provided with clapboards, to separate the neighboring planar scroll springs.

Beneficial Effect

By adopting the above technical solution, embodiments of the present application have at least the following beneficial effects. In the embodiments of the present application, the driving gear coaxial with the output shaft of the rotary power member is fixedly disposed on the output shaft of the rotary power member, and the first transmission gear is rotatably mounted to the housing and meshed with the driving gear. The roller shade actuation device is provided with at least two actuators connected linearly in sequence. The driving gear of one actuator adjacent to the transmission mechanism is transmission-matched with and connected to the transmission mechanism, and the driving gear of each of the remaining actuators is meshed with the first transmission gear of a neighboring actuator adjacent to the transmission mechanism. The at least two actuators are connected in series to form an actuator combination through the driving gears and the first transmission gears, to output good power to realize the winding of the roller shade. The assembly is easy and the combination adjustment of the driving force can be effectively realized.

DETAILED DESCRIPTION OF THE PRESENT INVENTION

Embodiments of the Present Application

The present application will be further described in detail below with reference to the accompanying drawings and specific embodiments. It should be understood that the following illustrative embodiments and illustrations are only used to explain the present invention and are not intended to limit the present invention, and that the embodiments of the present invention and the features of the embodiments can be combined with each other without conflict.

Figure 1:
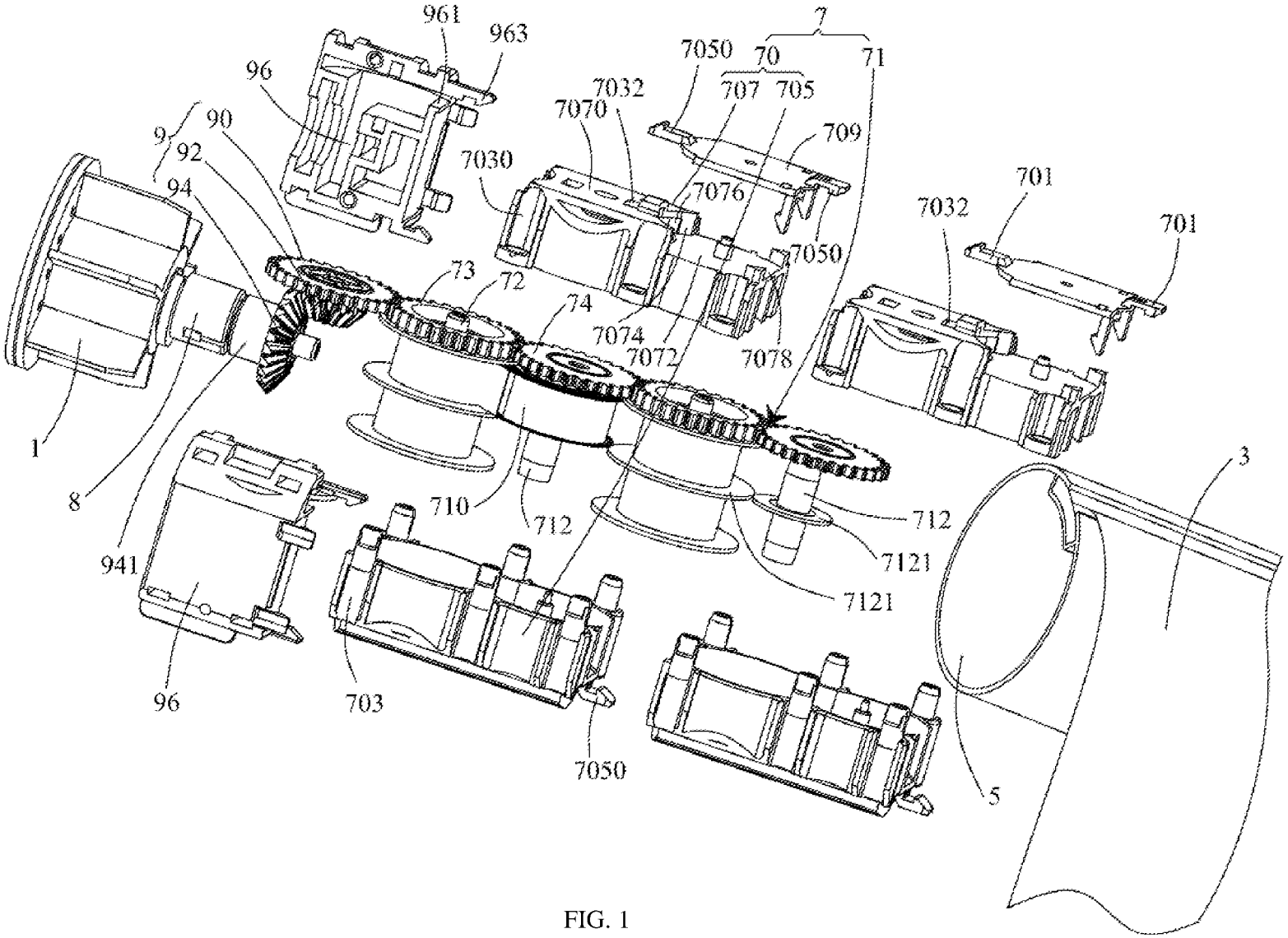
FIG. 1 is an exploded, isometric view of an embodiment of a roller shade actuation device.
Figure 2:
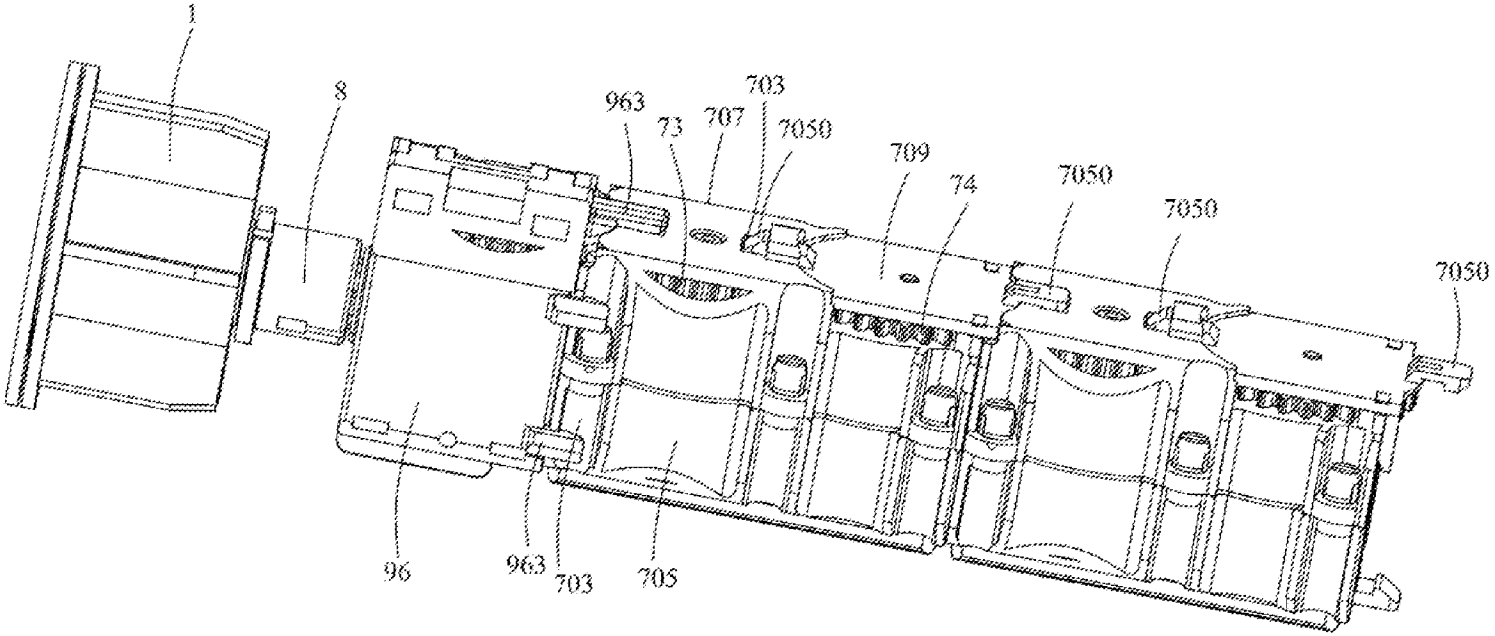
FIG. 2 is an assembled, isometric view of the embodiment of the roller shade actuation device.

Referring to FIGS. 1-2, an embodiment of the present disclosure provides a roller shade actuation device for actuating a winding drum 5 with opposite ends rotatably mounted to corresponding frames 1 and an outer side mounted with an end of a shade body 3. The roller shade actuation device includes an actuator 7 arranged in the winding drum, a shaft 8 fixed to one of the frames 1 outside an end of the winding drum and inserted into the winding drum, and a transmission mechanism 9 for realizing power transmission between the actuator 7 and the shaft 8. The actuator 7 includes a housing 70 fixed to the winding drum 5, and a rotary power member 71 arranged in the housing 70. The actuator 7 further includes a driving gear 73 fixed to an output shaft 72 of the rotary power member 71 and coaxial with the output shaft 72, and a first transmission gear 74 rotatably mounted to the housing 70 and meshed with the driving gear 73. The roller shade actuation device is provided with at least two actuators 7 connected linearly in sequence. The driving gear 73 of one of the actuators 7 adjacent to the transmission mechanism 9 is transmission-matched with and connected to the transmission mechanism 9, and the driving gears 73 of the remaining actuators 7 are meshed with the first transmission gears 74 of neighboring actuators 7 adjacent to the transmission mechanism 9.

In the embodiment, the driving gear 73 coaxial with the output shaft 72 is fixed to the output shaft 72 of the rotary power member 71, the first transmission gear 74 meshed with the driving gear 73 is rotatably mounted to the housing 70. The roller shade actuation device is provided with the at least two actuators 7 connected linearly in sequence. The driving gear 73 of one of the actuators 7 adjacent to the transmission mechanism 9 is transmission matched with and connected to the transmission mechanism 9, and the driving gears 73 of the remaining actuators 7 are meshed with the first transmission gears 74 of the neighboring actuators 7 adjacent to the transmission mechanism 9. The driving gears 73 and the first transmission gears 74 are used to connect the at least two actuators in series to form an actuator combination to output good power to realize the winding of the roller shade. The assembly is easy and the combination adjustment of the driving force can be effectively realized.

In another embodiment of the present application, the transmission mechanism 9 includes a second transmission gear 90 meshed with the driving gear 73, a synchronous gear 92 coaxial with the second transmission gear 90 and fixed relative to the second transmission gear 90, and a fixed gear 94 fixed to the shaft 8 and meshed with the synchronous gear 92. In the embodiment, the second transmission gear 90 is meshed with the driving gear 73, the synchronous gear 92 is coaxial with the second transmission gear 90 and fixed relative to the second transmission gear 90, and the fixed gear 94 is fixed to the shaft 8 and meshed with the synchronous gear 92. Therefore, the driving force output by the rotary power member is transmitted to the synchronous gear 92, and the synchronous gear 92 rotates about the fixed gear 94, thereby driving the entire actuator to rotate, and so as that the winding drum is selected to realize the winding of the roller shade.

In another embodiment of the present application, an axial direction of the output shaft 72 of the rotary power member 71 is perpendicular to an axial direction of the shaft 8. An axial direction of the driving gear 73 is parallel to an axial direction of the first transmission gear 74. The synchronous gear 92 and the fixed gear 94 are bevel gears whose axial directions are perpendicular to each other. In the embodiment, the axial direction of the output shaft 72 of the rotary power member 71 is perpendicular to the axial direction of the shaft 8, the axial directions of the driving gear 73 and the first transmission gear 74 are parallel, and the synchronous gear 92 and the fixed gear 94 are bevel gears whose axial directions are perpendicular to each other, so as that the radial size of the winding drum is less.

In another embodiment of the present application, the second transmission gear 90, the synchronous gear 92, and the fixed gear 94 are all disposed in a gear box 96. A sidewall of the gear box 96 adjacent to the actuator 7 defines a slot 961 through which gear teeth of the second transmission gear 90 extend out. A gear shaft 941 of the fixed gear 94 extends through a sidewall of the gear box 96 adjacent to the shaft 8 to be fixedly connected to the shaft 8. In the embodiment, the gear box 96 is provided to accommodate the second transmission gear 90, the synchronous gear 92, and the fixed gear 94, which can prevent foreign objects from getting caught in the meshing portions of the gear transmission, and effectively ensure the smoothness of transmission. The slot 961 is defined in the sidewall of the gear box 96 adjacent to the actuator 7 for the gear shaft of the second transmission gear 90 extending out, so as that the second transmission gear 90 can be meshed with the driving gear 73.

In another embodiment of the present disclosure, the sidewall of the gear box 96 adjacent to the actuator 7 forms a first hook 963. Opposite ends of the housing 70 of the actuator 7 respectively form a second hook 701 and a hooking portion 703. The actuator 7 adjacent to the gear box 96 is connected to the gear box 96 through the hooking portion 703 of the actuator 7 being hooked to the first hook 963 of the gear box 96. The remaining actuators 7 are connected linearly and integrally in sequence through the hooking portions 703 being hooked to the second hooks 701 of the neighboring actuators 7 adjacent to the gear box 96. Specifically, the hooking portion 703 may be provided as a hook hole 7030 or a hook slot 7032. In the embodiment, the first hook 963, the second hook 701, and the hooking portion 703 are provided to fasten and connect the actuator 7 adjacent to the gear box 76 to the gear box 76, and to fasten and linearly connect the actuators 7 at the side of the gear box 76 in sequence.

In another embodiment of the present disclosure, the housing 70 includes a bottom shell 705 and a cover shell 707 which are fastened to each other. A side surface of the cover shell 707 away from the bottom shell 705 is a stepped surface. The stepped surface has a high-order surface 7070, a lower-order surface 7072 parallel to the high-order surface 7070 and closer to the bottom shell 705, and a connection surface 7074 located between the high-order surface 7070 and the low-order surface 7072 and perpendicular to the high-order surface. The connection surface 7074 defines a first through slot 7076 communicating with an inner chamber of the housing 70. The driving gear 73 is arranged inside the housing 70 and near an inner side of the high-order surface 7070, and a gear surface of the driving gear 73 extends out through the first through slot 7076. The first transmission gear 74 is rotatably mounted to the low-order surface 7072. In the embodiment, the stepped surface and the first through slot 7076 are provided to facilitate the assembly and transmission cooperation of the driving gear 73 and the second transmission gear 74.

In another embodiment of the present disclosure, the housing 70 further includes a cover plate 709 covering the low-order surface 7072 of the cover shell 707 and the first transmission gear 74. A second through slot 7078 is defined between sides of the cover plate 709 and the low-order surface 7072, through which a gear surface of the first transmission gear 74 extends out. In the embodiment, the cover plate 709 covering the low-order surface 7072 of the cover 707 and the first transmission gear 74 is provided to enhance the sealing of the housing 70 and to prevent foreign matter from entering the housing 70. The second through slot 7078 is defined between the sides of the cover plate 709 and the lower-order surface 7072, through which the gear surface of the first transmission gear 74 extending out, which facilitates the assembly and transmission cooperation of the first transmission gear 74 and the driving gear 73.

In another embodiment of the present disclosure, opposite ends of the bottom shell 705 are respectively provided with the second hook 7050 and the hooking portion 703, opposite ends of the high-order surface 7070 are provided with the hooking portions 703, and opposite ends of the cover plate 709 are respectively provided with the second hooks 7050. The second hook 7050 of the cover plate 709 adjacent to the high-order surface 7070 is engaged with the hooking portion 703 of the high-order surface 7070 adjacent to the lower-order surface 7072. In the embodiment, the hooking portions 703 and the second hooks 7050 are set at corresponding positions, to ensure stable connection between every two adjacent actuators 7, and between the gear box 96 and the neighboring actuator 7.

In another embodiment of the present disclosure, the rotary power member 71 further includes a planar scroll spring 710, and a spring winding frame 712 for winding the planar scroll spring 710. Axial directions of the planar scroll spring 710 and the output shaft 72 are parallel. An outer end of a reed of the planar scroll spring 710 is fixed to a side surface of the output shaft 72. In the embodiment, the planar scroll spring 710 is provided, and the outer end of the reed of the planar scroll spring 710 is fixed to the side surface of the output shaft 72. The planar scroll spring 710 functions as a power member to drive the output shaft 72 to rotate. The controllability of the driving force is strong, which can better design the driving force required when the roller shade is retracted or released, and the overall structure is simple, easy to be assembled and easy to be controlled.

In another embodiment of the present disclosure, each of the rotary power members 71 includes at least two planar scroll springs 710 coaxially wound on the same spring winding frame 712. The spring winding frame 712 and the output shaft 72 are provided with clapboards 7121, to separate the neighboring planar scroll springs 710. In the embodiment, at least two planar scroll springs 710 coaxially wound on the same spring winding frame 712 are provided, to provide a good driving force for the rotary power member 71. Both the spring winding frame 712 and the output shaft 72 are provided with the clapboards 7121, to prevent interference between the neighboring planar scroll springs 710 and ensure the smoothness of the transmission.

The embodiments of the present application have been described above with reference to the accompanying drawings, but the present application is not limited to the specific implementations described above, and the specific implementations described above are only schematic and not limiting. Under the enlightenment of this application, many forms can be made without departing from the scope of this application and the scope of protection of the claims, and these are all included in the scope of protection of this application.

INDUSTRIAL APPLICABILITY

By adopting the above technical solution, the embodiment of the present application has at least the following beneficial effects. In the embodiment of the present application, the driving gear coaxial with the output shaft of the rotary power member is fixedly disposed on the output shaft of the rotary power member, and the first transmission gear is rotatably mounted to the housing and meshed with the driving gear. The roller shade actuation device is provided with at least two actuators connected linearly in sequence. The driving gear of one actuator adjacent to the transmission mechanism is transmission-matched with and connected to the transmission mechanism, and the driving gear of each of the remaining actuators is meshed with the first transmission gear of a neighboring actuator adjacent to the transmission mechanism. The at least two actuators are connected in series to form an actuator combination through the driving gears and the first transmission gears, to output good power to realize the winding of the roller shade. The assembly is easy and the combination adjustment of the driving force can be effectively realized.

What is claimed is:

1. A roller shade actuation device for actuating a winding drum with opposite ends rotatably mounted to corresponding frames and an outer side mounted with an end of a shade body, comprising:

at least two actuators arranged in the winding drum;

a shaft mounted to one of the frames outside an end of the winding drum and inserted into the winding drum; and a transmission mechanism for realizing power transmission between the at least two actuators and the shaft;

wherein each of the at least two actuators comprises a housing fixed relative to the winding drum, a rotary power member arranged in the housing, a driving gear fixed to an output shaft of the rotary power member and coaxial with the output shaft, and a first transmission gear rotatably mounted to the housing and meshed with the driving gear;

wherein the at least two actuators are connected linearly in sequence; the driving gear of one of the at least two actuators adjacent to the transmission mechanism is transmission-matched with and connected to the transmission mechanism, and the driving gears of another of the at least two actuators are meshed with the first transmission gears of the one actuator of the at least two actuators adjacent to the transmission mechanism;

wherein the transmission mechanism comprises a second transmission gear meshed with the driving gear, a synchronous gear coaxial with and fixed relative to the second transmission gear, and a fixed gear fixed to the shaft and meshed with the synchronous gear;

wherein the second transmission gear, the synchronous gear, and the fixed gear are all disposed in a gear box; a sidewall of the gear box adjacent to the at least two actuators defines a slot through which gear teeth of the second transmission gear extend out, a gear shaft of the fixed gear extends through a sidewall of the gear box adjacent to the shaft to be connected to the shaft and fixed relative to the shaft;

wherein the sidewall of the gear box adjacent to the at least two actuators forms a first hook, opposite ends of the housing of each of the at least two actuators respectively form a second hook and a hooking portion, one of the at least two actuators adjacent to the gear box is connected to the gear box through the hooking portion of the actuator being hooked to the first hook of the gear box; the remaining actuators of the at least two actuators are connected linearly and integrally in sequence through the hooking portions being hooked to the second hooks of neighboring actuators of the at least two actuators adjacent to the gear box; and wherein the housing comprises a bottom shell and a cover shell which are fastened to each other; a side surface of the cover shell away from the bottom shell is a stepped surface, the stepped surface has a high-order surface, a lower-order surface parallel to the high-order surface and closer to the bottom shell, and a connection surface located between the high-order surface and the low-order surface and perpendicular to the high-order surface;

the connection surface defines a first through slot communicating with an inner chamber of the housing, the driving gear is arranged inside the housing and near an inner side of the high-order surface, and a gear surface of the driving gear extends out through the first through slot; the first transmission gear is rotatably mounted to the low-order surface.

2. The roller shade actuation device of claim 1, wherein an axial direction of the output shaft of the rotary power member is perpendicular to an axial direction of the shaft, an axial direction of the driving gear is parallel to an axial direction of the first transmission gear, the synchronous gear and the fixed gear are bevel gears whose axial directions are perpendicular to each other.

3. The roller shade actuation device of claim 1, wherein the housing further comprises a cover plate for covering the low-order surface of the cover shell and the first transmission gear, a second through slot is defined between sides of the cover plate and the low-order surface, through which a gear surface of the first transmission gear extends out.

4. The roller shade actuation device of claim 3, wherein opposite ends of the bottom shell are respectively provided with the second hook and the hooking portion, opposite ends of the high-order surface are provided with the hooking portions, and opposite ends of the cover plate are respectively provided with the second hooks, the second hook of the cover plate adjacent to the high-order surface is engaged with the hooking portion of the high-order surface adjacent to the lower-order surface.

5. The roller shade actuation device of claim 1, wherein the rotary power member further comprises a planar scroll spring, and a spring winding frame for winding the planar scroll spring; axial directions of the planar scroll spring and the output shaft are parallel, an outer end of a reed of the planar scroll spring is fixed to a side surface of the output shaft.

6. The roller shade actuation device of claim 5, wherein each of the rotary power members comprises at least two planar scroll springs coaxially wound on the same spring winding frame; the spring winding frame and the output shaft are provided with clapboards, to separate the planar scroll springs.

* * * * *